US006250944B1

(12) United States Patent
Jones

(10) Patent No.: US 6,250,944 B1
(45) Date of Patent: Jun. 26, 2001

(54) LATCH DEVICE FOR RELEASABLY LOCKING MATING ELECTRICAL CONNECTORS TOGETHER

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/603,798

(22) Filed: Jun. 26, 2000

(51) Int. Cl.[7] ..... H01R 13/627
(52) U.S. Cl. ..... 439/352
(58) Field of Search ..... 439/352, 353, 439/357

(56) References Cited

U.S. PATENT DOCUMENTS 5,549,481 * 8/1996 Morlion et al. ..... 439/608
5,975,929 * 11/1999 Matsuura et al. ..... 439/352

* cited by examiner

*Primary Examiner*—Brian Sircus
*Assistant Examiner*—Phuong K T Dinh
(74) *Attorney, Agent, or Firm*—Wei Te Chung

(57) ABSTRACT

An electrical connector assembly has a lower connector (3) and an upper connector (4), the lower and upper connectors having a latch device. The latch device of the upper connector includes a pair of resilient arms (42) at lateral sides thereof with a shoulder portion at an lower end of each resilient arm. The latch device of the lower connector includes a pair of locking arms (32) located correspond with the resilient arms, a pair of locking tips (324) being formed at a top end of each locking arm (32), and a pair of push bars (34) formed as part of an insulative housing of the lower connector and disposed to an outside of the locking arms. In use, the locking tips (324) of the lower connector lock with and form a grounding path with the shoulder portions of the upper connector. Each resilient arm includes a pair of outer resilient plates (421) extending outwardly and a central resilient plate (422) extending inwardly. For conveniently disengaging the mated upper and lower connectors from each other, each push bar (34) provides a projection portion (342) for inwardly pushing the resilient arms of the upper connector.

9 Claims, 9 Drawing Sheets

LATCH DEVICE FOR RELEASABLY LOCKING MATING ELECTRICAL CONNECTORS TOGETHER

BACKGROUND OF THE INVENTION

The present invention relates to a latch device, and particularly to an electrical connector assembly having a latch device for positively locking together and electrostatically grounding two component to mating electrical connectors.

Generally, to insure a reliable connection between a pair of mating electrical connectors, a latch device is used for attaching the mating connectors together. Commonly, the latch device is formed on an insulative housing of each connector for easy manufacturing and operation. Related inventions are disclosed in U.S. Pat. Nos. 4,63,204, 4,648, 665, 5,002,504, 5,015,199 and 5,083,933. Referring to FIGS. 1–2, a first electrical connector 1 comprises a pair of first latch arms 11 and a second electrical connector 2 comprises a pair of second latch arms 21. After mating, the first and second latch arms 11, 21 engage with each other to prevent the mating connectors 1, 2 from separating from each other.

However, during the mating process, the first and second latch arms 11, 21 do not automatically lock with each other. Furthermore, both the first and second latch arms 11, 21 are formed as part of the insulative bodies of the connectors 1, 2, respectively. Therefore the first and second latch arms 1, 2 can not provide a grounding function, and an additional grounding connection is required between the connectors. Finally, the latch arms 11, 21, which are made of insulative material (usually plastic), are not strong enough to retain a positive lock under a rough handling.

Thus, there is a need for a latch device which provides a grounding and a positive locking function between a pair of mating electrical connectors.

BRIEF SUMMARY OF THE INVENTION

A main object of the present invention is to provide an electrical connector assembly having a latch device for providing grounding and positive locking function between mating electrical connectors thereof.

To fulfill the above-mentioned object, according to a preferred embodiment of the present invention, an upper connector comprises a pair of metallic resilient arms fixed at lateral sides thereof. A lower connector comprises a pair of metallic locking arms located to correspond to the resilient arms of the upper connector. Each resilient arm comprises a pair of outer resilient plates extending outwardly and a central resilient plate extending inwardly. Both lower ends of the outer resilient plates are connected by a shoulder portion and a lower end of the central resilient plate is separated from the shoulder portion. The locking arm comprises an elongated body, a base plate perpendicularly extending from a lower edge of the elongated body, and a pair of boardlocks downwardly extending from the base plate for attaching the lower connector to a printed circuit board. A pair of locking tips perpendicularly extends from lateral sides of a top portion of the elongated body for locking with a corresponding shoulder portion. A pair of push bars is integrally formed with an insulative housing of the lower connector and is operable to release the engagement between the locking tips and the shoulder portion. Thus, the upper and lower connectors can be conveniently disengaged from each other.

Other objects, advantages and novel features of the invention will become more apparent from the following detailed description when taken in conjunction with the accompanying drawings.

DETAILED DESCRIPTION OF THE INVENTION

Figure 1:
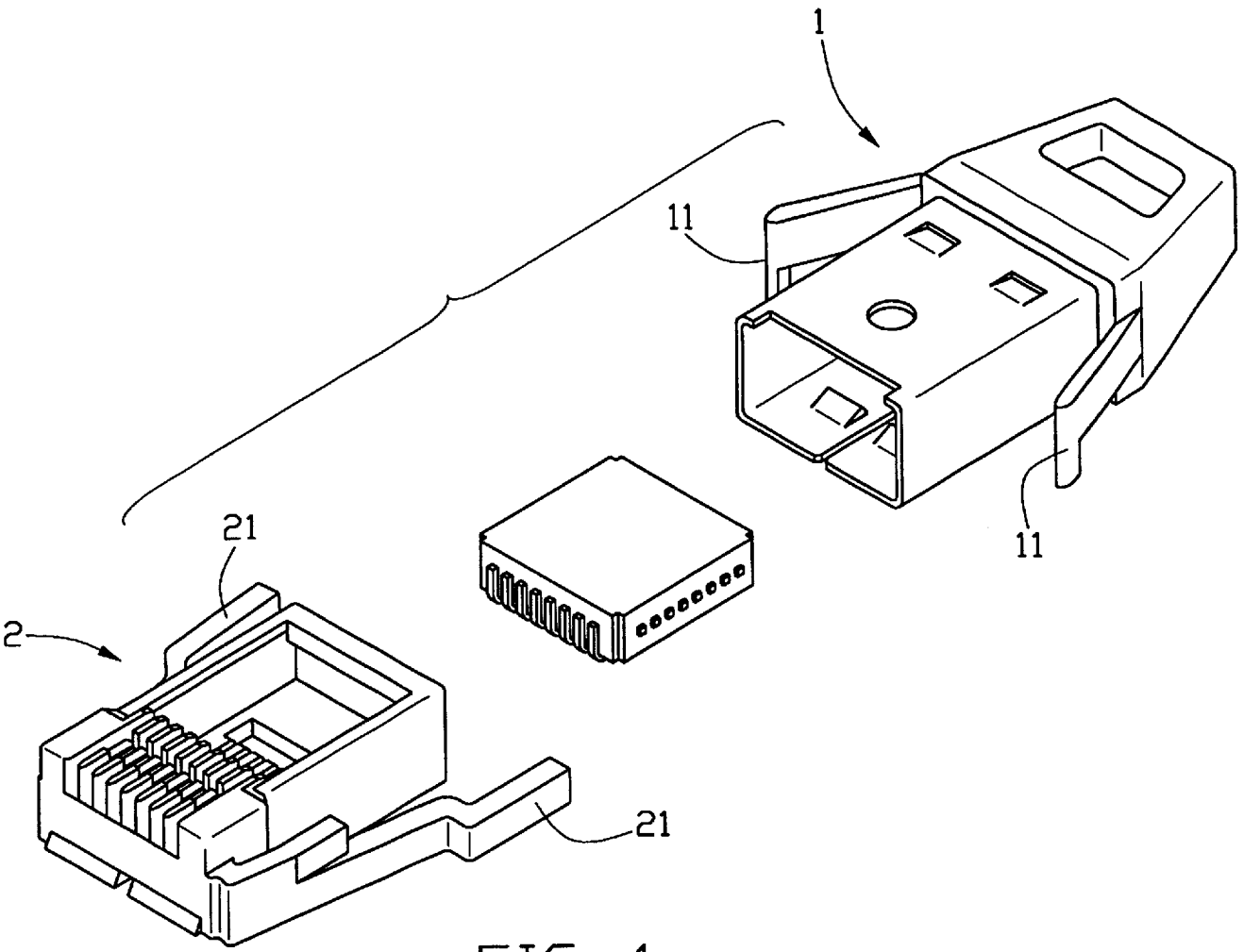
FIG. 1 PRIOR ART
FIG. 1 is a perspective, exploded view of two conventional electrical connectors to be mated with each other.
Figure 2:
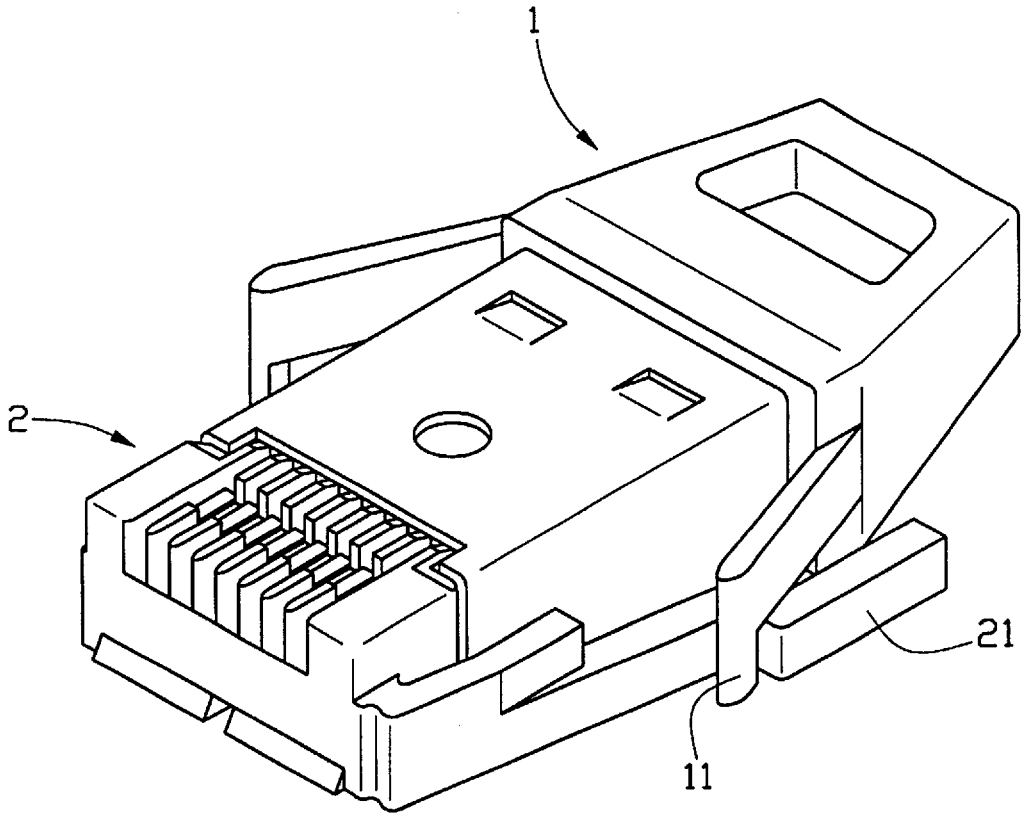
FIG. 2 PRIOR ART
FIG. 2 is a perspective view of the two connectors of FIG. 1 mated with each other.
Figure 3:
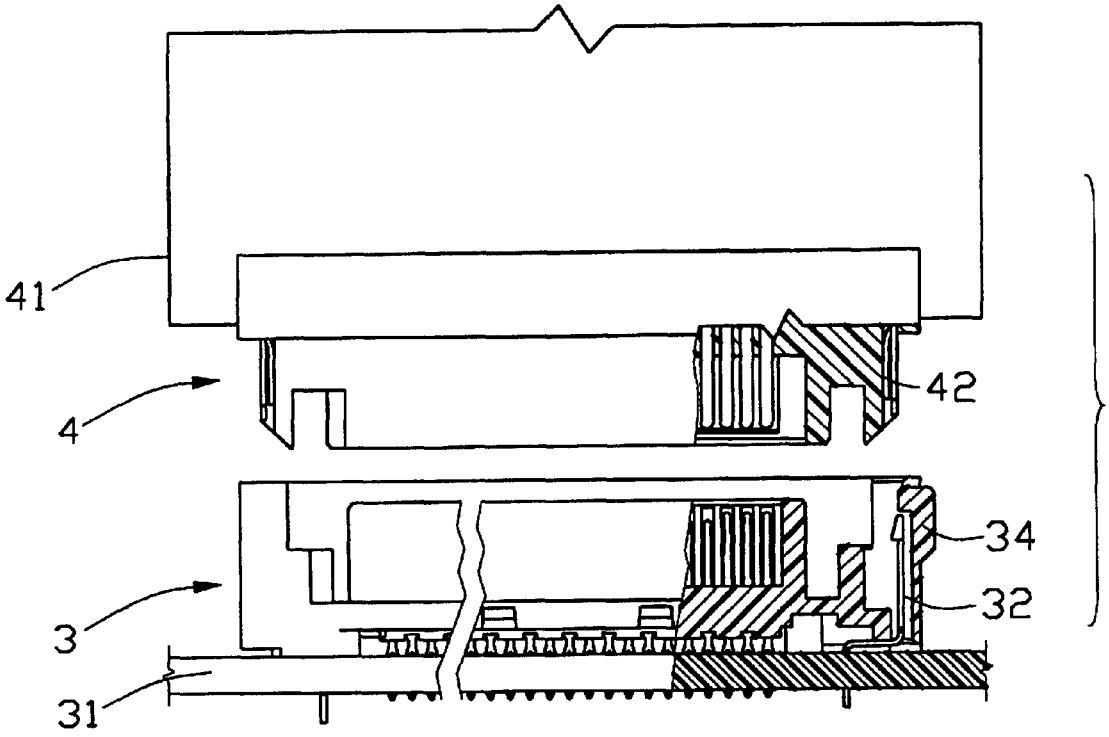
FIG. 3 is a partially cross-sectional view showing two electrical connectors in accordance with the present invention which are respectively attached to printed circuit boards.
Figure 4:
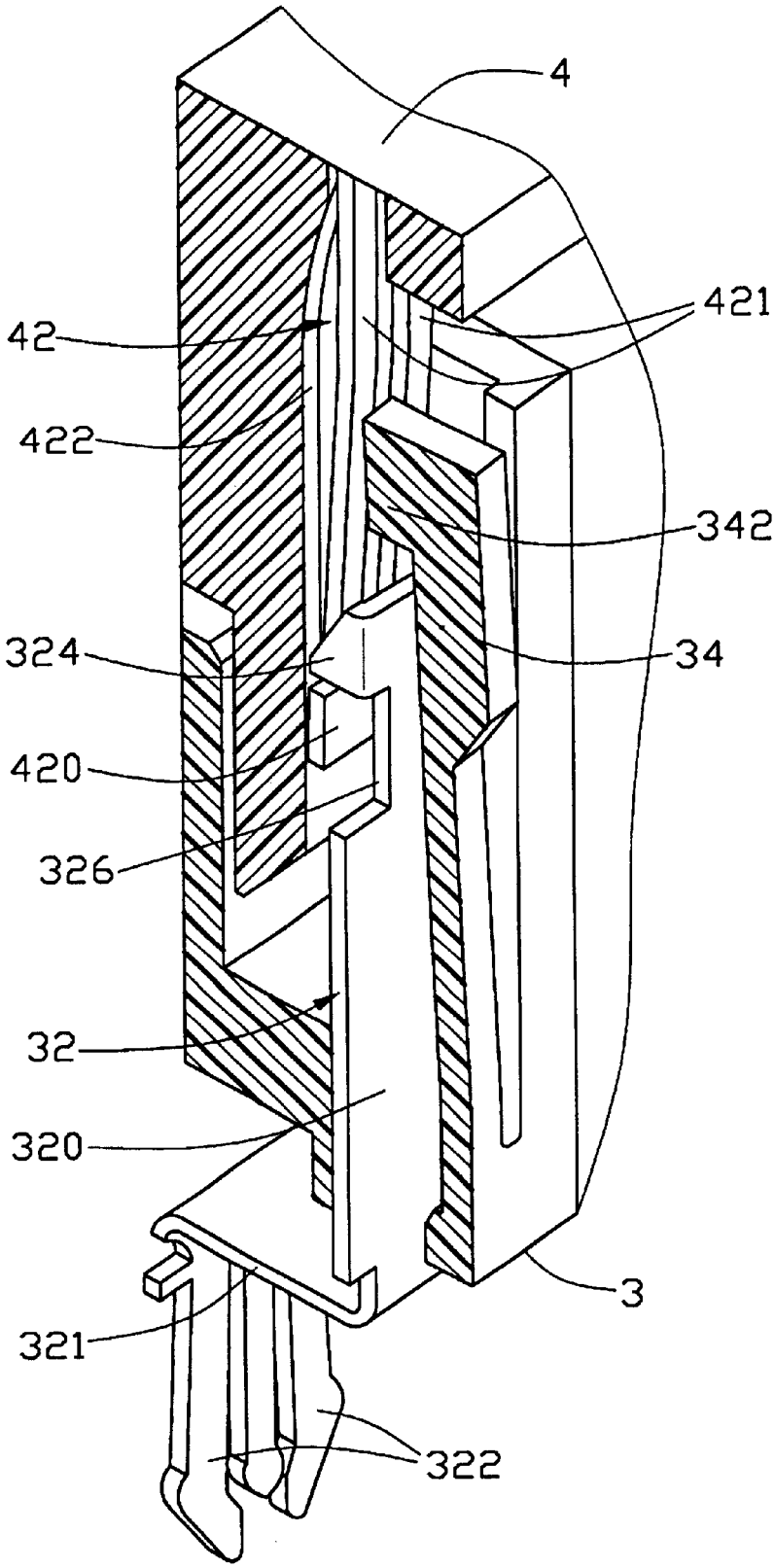
FIG. 4 is an enlarged, perspective, partially cross-sectional view showing a latch device assembled in the mated connectors of FIG. 3.

Referring to FIGS. 3–4, an electrical connector assembly comprises a lower connector 3 and an upper connector 4. The lower and upper connectors 3, 4 are respectively mounted to printed circuit boards 31, 41, wherein in the preferred embodiment, the printed circuit board 31 is a mother board, and the printed circuit board 41 is a daughter board. The upper connector 4 comprises a pair of resilient arms 42 at lateral sides thereof. The lower connector 3 comprises a pair of locking arms 32 located corresponding to the resilient arms 42. The resilient arms 42 and the locking arms 32 are all made of metal material.

Each resilient arm 42 comprises a pair of outer resilient plates 421 extending outwardly and a central resilient plate 422 extending inwardly. The outer resilient plates 421 are connected by a locking shoulder portion 420 at a lower end of the arm 42. And a low end of the central resilient plate 422 is separated from the shoulder portion 420. An upper portion of the resilient arm 42 is securely positioned in the upper connector 4.

The locking arm 32 comprises an elongated body 320, a base plate 321 perpendicularly extending from a lower edge of the elongated body 320 and a pair of boardlocks 322 downwardly extending from the base plate 321 for attaching the lower connector 3 to the printed circuit board 31. A grounding circuit path is connected to corresponding holes of the printed circuit board 31 for electrically contacting the boardlocks 322 of the locking arm 32 thereby connecting the boardlocks 322 to grounding potential when the lower connector 3 is connected to the printed circuit board 31. A pair of locking tips 324 perpendicularly extends from lateral sides of a top portion of the elongated body 320 for locking with the corresponding shoulder portion 420. A pair of cutouts 326 is respectively formed in lateral sides of the elongated body 320 below the locking tips 324. A push bar 34 is integrally formed with an insulative housing (not labeled) of the lower connector 3, and located outside a corresponding locking arm 32. The push bar 34 comprises a projection portion 342 inwardly extending from a top portion thereof.

Figure 5:
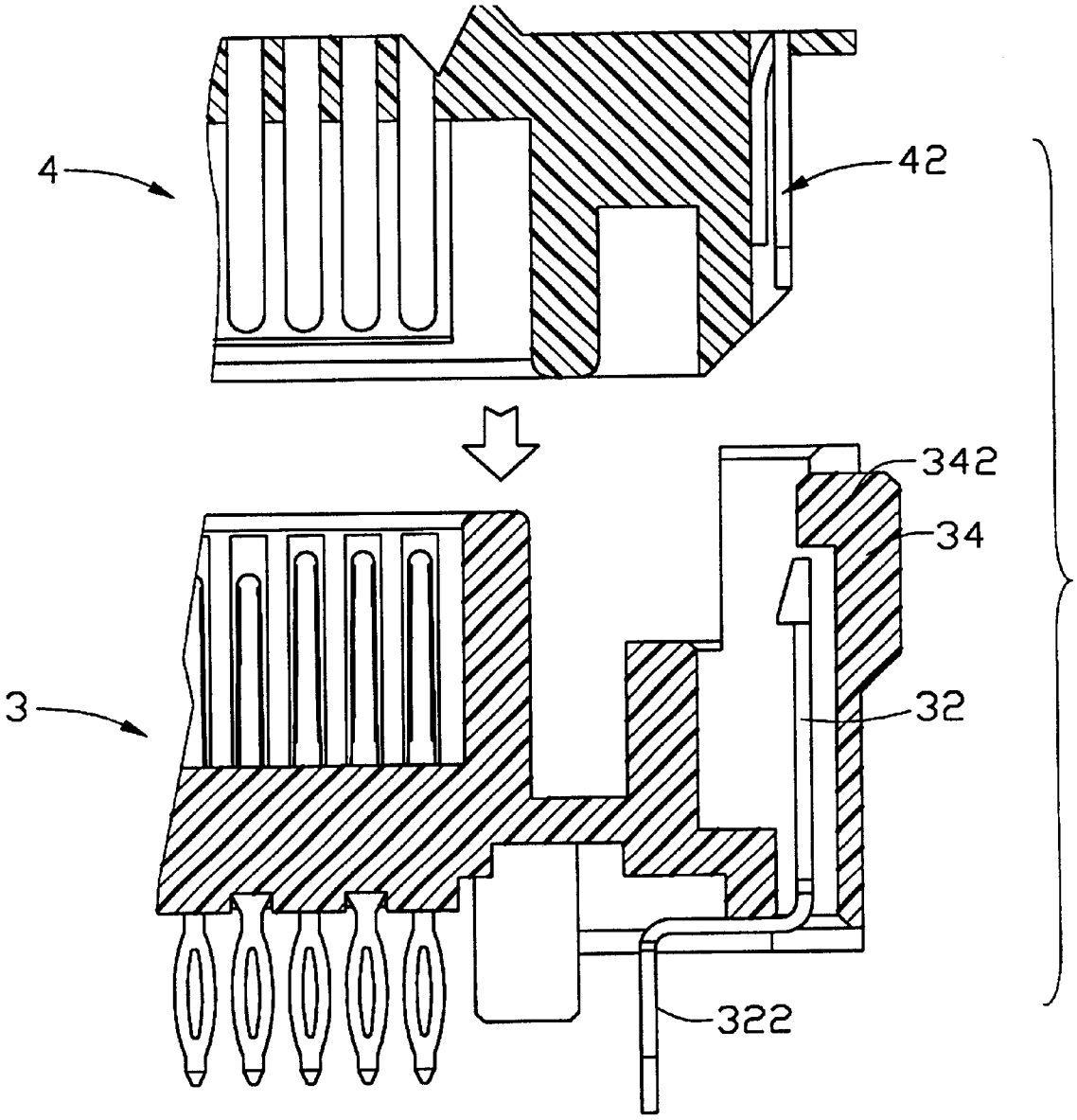
FIG. 5 is an enlarged, cross-sectional view of the latch device of FIG. 4 respectively mounted in the connectors of the present invention before assembly.
Figure 6:
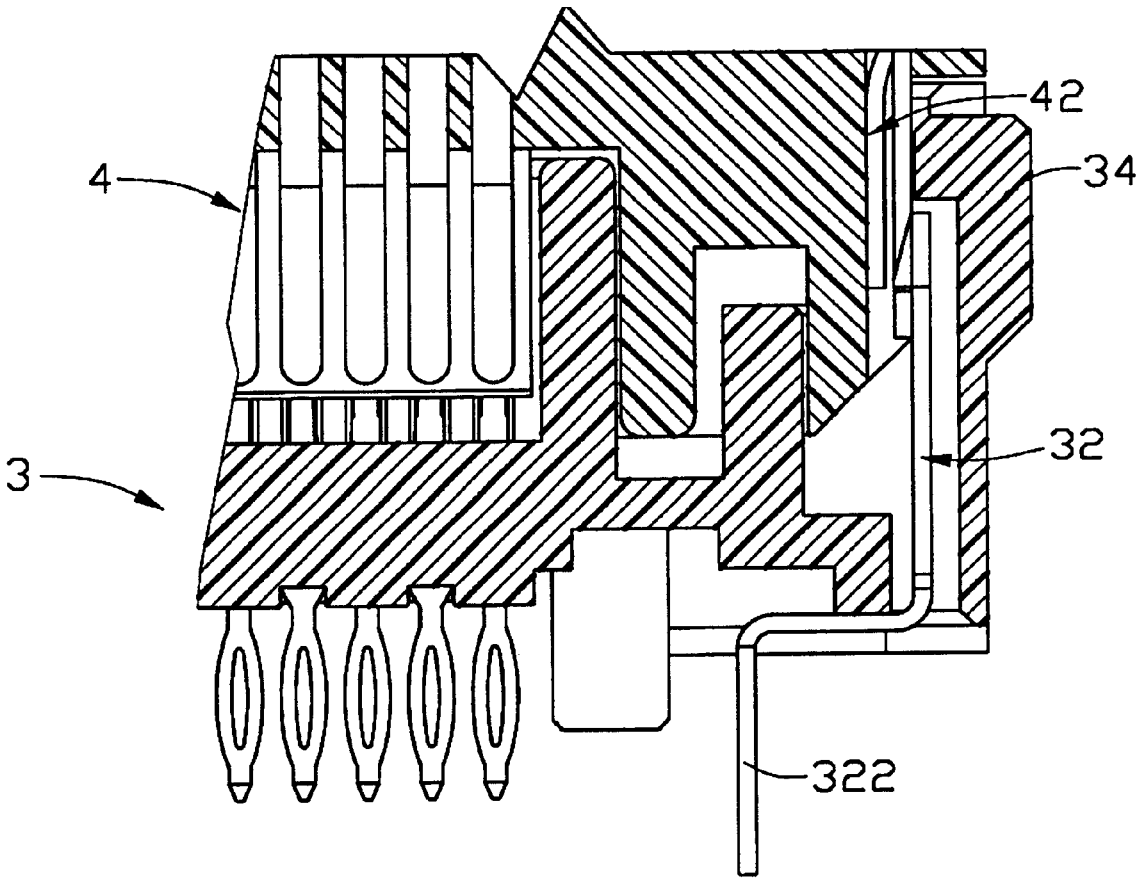
FIG. 6 is a view similar to FIG. 5 wherein the connectors are assembled together.

Referring to FIGS. 5–6, the upper connector 4 is inserted downwardly to engage with the lower connector 3. During the mating process, the locking tips 324 of the locking arms 32 easily slide over and lock with the shoulder portions 420 of the resilient arms 42. Thus, the upper connector 4 and lower connector 3 are securely mated together. Furthermore, a grounding path is established between the lower and upper connectors 3, 4 by the electrical engagement of the locking arms 32 with the resilient arms 42.

Figure 7:
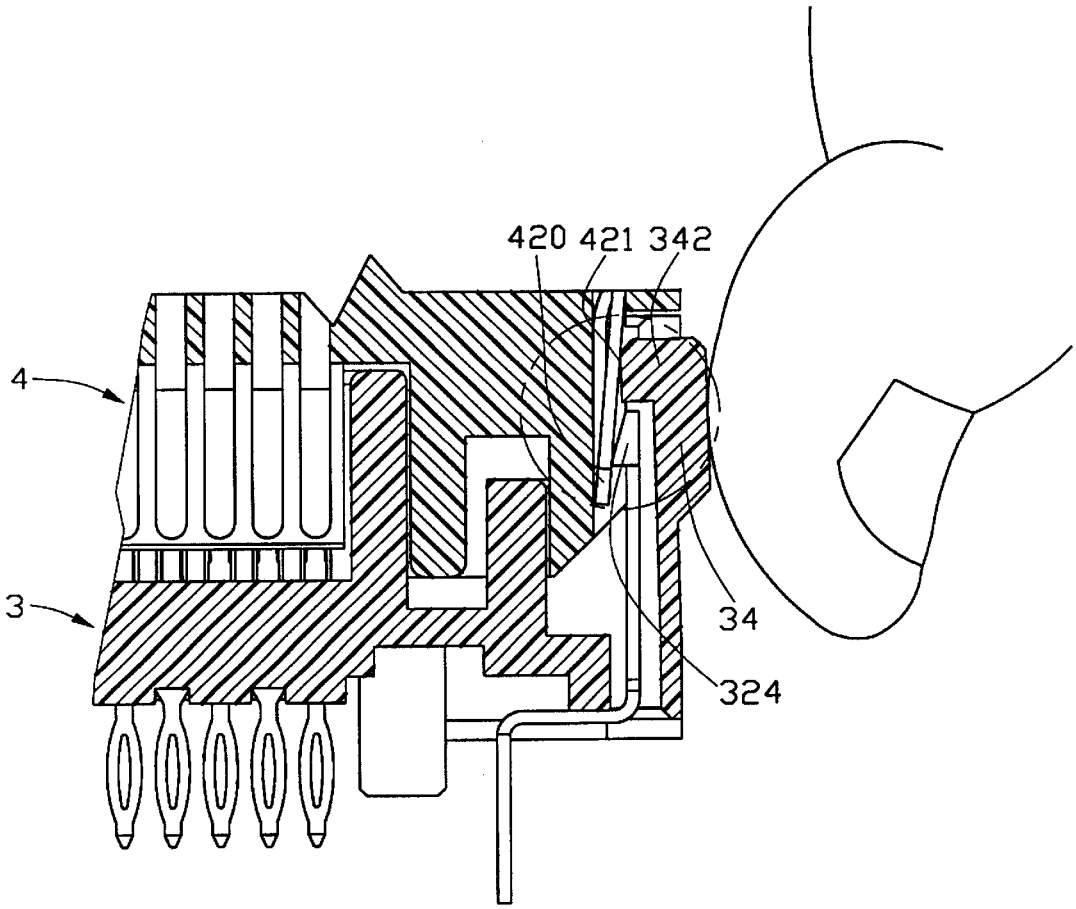
FIG. 7 is a view similar to FIG. 5 wherein the connectors are in the process of being disengaged by a finger.
Figure 8:
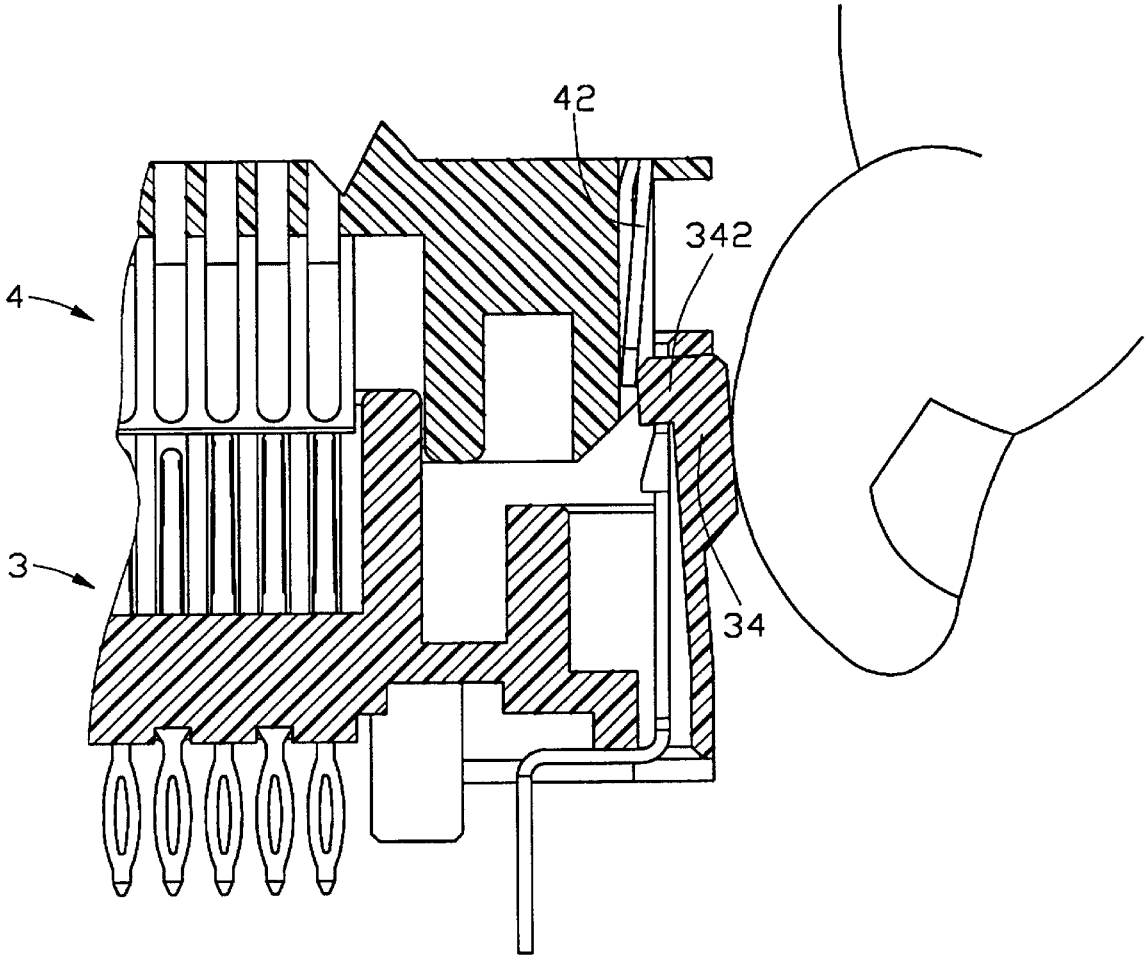
FIG. 8 is a view similar to FIG. 7 wherein the mated connectors are disengaged from each other.
Figure 9:
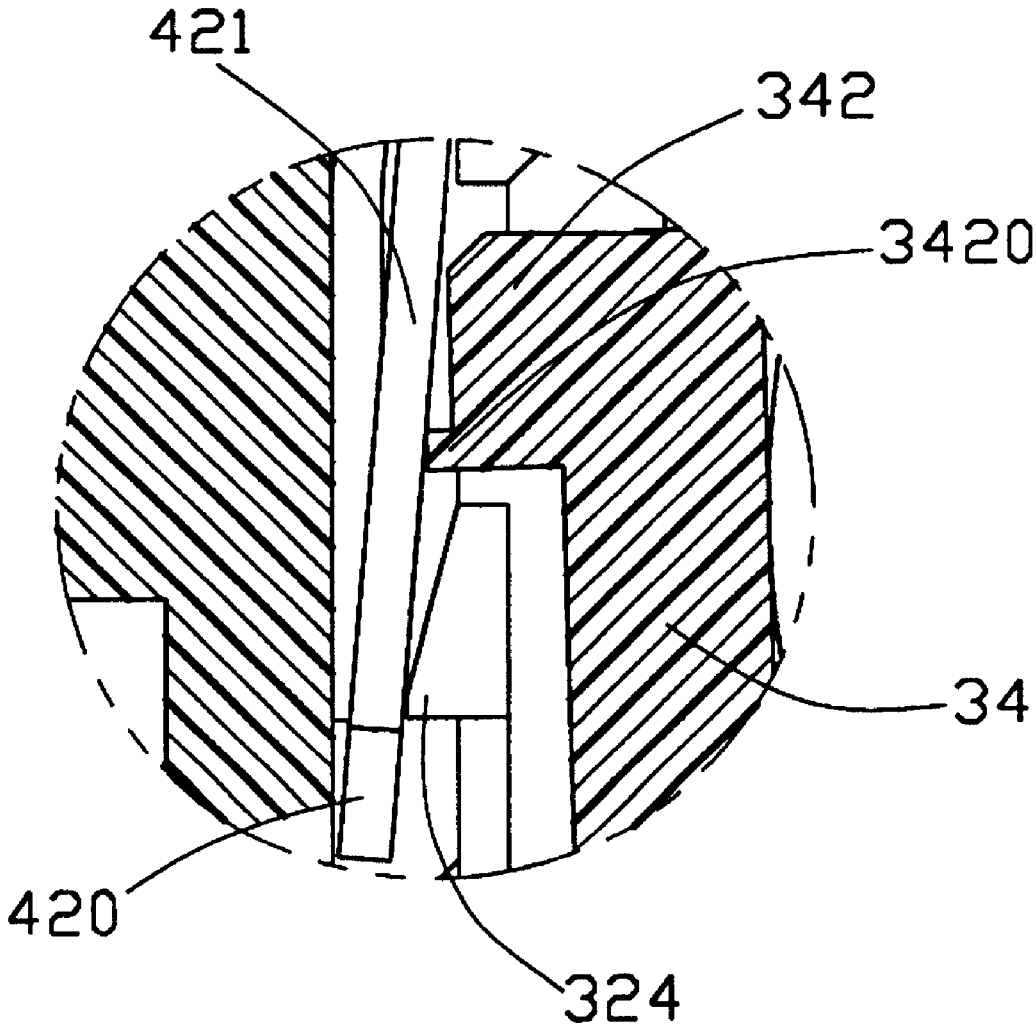
FIG. 9 is an enlarged, cross-sectional view of an alternate embodiment of present invention.

Referring to FIGS. 7–8, to unmate the two connectors 3, 4, the push bars 34 are pressed inwardly to cause the projection portions 342 to push corresponding outer resilient arms 421 inwardly so that the shoulder portions 420 disengage from the locking tips 324. Thus, the upper connector 4 can be freely withdrawn from the lower connector 3. Further referring to FIG. 9, in an alternate embodiment, the projection portion 342 is designed with a projection tip 3420. Thus, the outer resilient arms 421 can be easily pressed inwardly and the locking tips 324 are easily disengaged from the shoulder portions 420.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for signal transmission between different printed circuit boards, comprising:

an upper connector having a pair of metallic resilient arms located at lateral sides of the upper connector, each resilient arm comprising a pair of outer resilient plates extending outwardly and a central resilient plate extending inwardly, both lower ends of the outer resilient plates being connected by a shoulder portion and a lower end of the central resilient plate being separated from the shoulder portion; and a lower connector matable with the upper connector, having a pair of metallic locking arms at lateral sides corresponding to the resilient arms of the upper connector, a pair of push bars extending from an insulative housing of the lower connector and located at outer sides of the locking arms, said locking arms latching with the resilient arms, respectively, and said push bars being operable to move inwardly to unlatch the locking arms from the resilient arms.

2. The electrical connector assembly as claimed in claim 1, wherein the mated upper and lower connectors are respectively mounted on a daughter and a mother printed circuit boards for electrical signal transmission therebetween.

3. The electrical connector assembly as claimed in claim 1, wherein each locking arm comprises an elongated body, a base plate perpendicularly extending from a lower edge of the elongated body and a pair of boardlocks downwardly extending from the base plate for attaching the lower connector to a corresponding printed circuit board.

4. The electrical connector assembly as claimed in claim 3, wherein a pair of locking tips perpendicularly extends from lateral sides of the top portion of the elongated body.

5. The electrical connector assembly as claimed in claim 1, wherein each push bar comprises a projection portion extending inwardly for pressing inwardly a corresponding outer resilient arm of the upper connector.

6. The electrical connector assembly as claimed in claim 3, wherein a circuit path is formed in the printed circuit board and electrically contacts the boardlocks of the locking arm for grounding static electricity accumulated thereon.

7. A latch device for latching two mated first and second connectors together, comprising:

a metallic resilient arm fixed to the first connector;

an elongated, metallic locking arm fixed to the second connector, having a first end for locking into a printed circuit board to electrically connect with a grounding circuit thereof and a second end engaging with the resilient arm when the first and second connectors are mated together; and a push bar integrally formed with an insulative housing of the second connector and operable to release the engagement between the second end of the locking arm and the resilient arm whereby the first and second connectors can be unmated with each other.

8. An electrical connector assembly comprising:

a first connector being mounted on a first printed circuit board and including at least one resilient plate on a lateral side with a locking portion thereof; and a second connector being mounted on a second printed circuit board and including at least a stationary locking arm on a lateral side with a locking tip thereof, and a deflectable push bar protectively positioned beside the locking arm, the locking arm further including a downward extending board lock, opposite to the locking tip, which is attached to the second printed circuit board; wherein the first connector and the second connector are mated with each other in a front-to-back direction and the locking portion of the first connector is latchably engaged with the locking tip of the second connector, while when unmated, first the push bar is laterally and inwardly, in a second direction which is perpendicular to said first direction, deflected to actuate the resilient plate to move inwardly and disengage the locking portion of the resilient plate from the locking tip of the locking arm, and the first connector and the second connector are withdrawn from each other in said front-to-back direction.

9. The assembly as claimed in claim 8, wherein said first printed circuit board and said second printed circuit board are perpendicular to each other.

* * * * *